US006678977B1

(12) United States Patent
Sherman

(10) Patent No.: US 6,678,977 B1
(45) Date of Patent: Jan. 20, 2004

(54) DOCUMENT HOLDER

(76) Inventor: Alan Sherman, 7639 Westmoreland Ave., Clayton, MO (US) 63105

( * ) Notice: Subject to any disclaimer, the term of this patent is extended or adjusted under 35 U.S.C. 154(b) by 0 days.

(21) Appl. No.: 10/348,303

(22) Filed: Jan. 21, 2003

(51) Int. Cl.[7] ..... B41J 11/30
(52) U.S. Cl. ..... 40/341; 40/658; 248/451; 248/450
(58) Field of Search ..... 40/658, 341, 606; 248/176.1, 473, 450, 451

(56) References Cited

U.S. PATENT DOCUMENTS 3,325,929 A * 6/1967 Mauchline ..... 40/658
3,787,922 A * 1/1974 Foy et al. ..... 248/473
3,994,460 A * 11/1976 Geiger ..... 248/176.1
4,075,773 A * 2/1978 Daster ..... 40/658
4,089,116 A 5/1978 Bearinger
4,125,243 A * 11/1978 Liptak ..... 248/473
4,882,862 A * 11/1989 Slavsky, Sr. ..... 40/658
5,845,889 A * 12/1998 Suzuki ..... 248/451
5,857,654 A * 1/1999 Berman ..... 40/606
5,911,398 A * 6/1999 VanLandingham, Jr. ..... 40/658
6,059,249 A * 5/2000 Scatterday ..... 248/450
6,267,346 B1 * 7/2001 Dill et al. ..... 248/473

* cited by examiner

*Primary Examiner*—Gary Hoge
(74) *Attorney, Agent, or Firm*—Polster, Lieder, Woodruff & Lucchesi

(57) ABSTRACT

A document holder is provided which can be mounted to a vertical or horizontal surface. The document holder, which is substantially smaller than a regular 8½"×11" sheet of paper frictionally holds the paper in place for reading.

14 Claims, 4 Drawing Sheets

DOCUMENT HOLDER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates primarily to document and note holders, and, in particular to a document or note holder which can be mounted to a surface, such as a desk, cabinet, computer monitor, telephone, etc. to hold a document or note in any desired orientation.

Document holders are commonly used in offices to support papers, memos, notes, and other documents in a manner in which a typist can fairly easily view the document. Often, document holders are mounted to the side of a computer monitor. Such document holders typically include a back surface with a bottom ledge, and the sheet of paper sits on the bottom ledge and rests against the back surface. The paper is held in place, for example, using clips at the top of the back surface or an arm or bar which extends across the page.

Other document holders have been provided which can simply be placed on a desk (or counter) top to hold a note, memo, or other document. One such document holder is shown in U.S. Pat. No. 4,089,116. This document holder is in the form of a ruler having a slot in the top, which receives papers. The slot is closed on its sides, and hence, the holder is limited to receiving papers having a width slightly less than the length of the slot. Alternating blades in the slot form corrugations in the paper to hold the paper upright.

BRIEF SUMMARY OF THE INVENTION

Briefly stated, a document holder is provided which can be mounted to either a vertical or horizontal surface so that the document holder will project vertically upwardly or downwardly or horizontally, as the user chooses to frictionally hold one or more sheets of paper from the top, bottom, or sides. The document holder includes a base and front and back walls extending from the base. The front and back walls each have inner and outer surfaces and are spaced apart to define a slot between the front and back walls. Projections extend from the inner surface of the two walls. Preferably, there are at least three projections: one inner projection extending from the inner surface of one of the walls and two outer projections extending from the inner surface of the other of the walls. The projections are arranged in an alternating pattern. Additionally, the projections are sized and spaced such that, when paper is inserted in the holder, the inner projection will push the paper against the outer projections, and the outer projections will push the paper against the inner projections such that the paper will be frictionally engaged by the edges of the inner and outer projections. Further, the inner surfaces of at least the inner projection or the outer projections are sloped, such that the distance between the sloped projections and the opposing wall varies along the height of the sloped projections. These surfaces define friction-inducing edges, which engage paper, which is inserted in the document holder to frictionally grip the paper. The friction grip is sufficiently strong to prevent the sheet(s) of paper from sliding through, or rotating out of, the document holder under the weight of the paper, even if the holder is completely inverted with the paper projecting downwardly from the slot. To help ensure that the paper remains generally flat or planer when held by the document holder, the document holder includes channels at opposite edges which open into the slot. The channels are co-linear or in the same plane with each other. The channels can be formed, for example, by extensions projecting outwardly from sidewalls of the holder.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
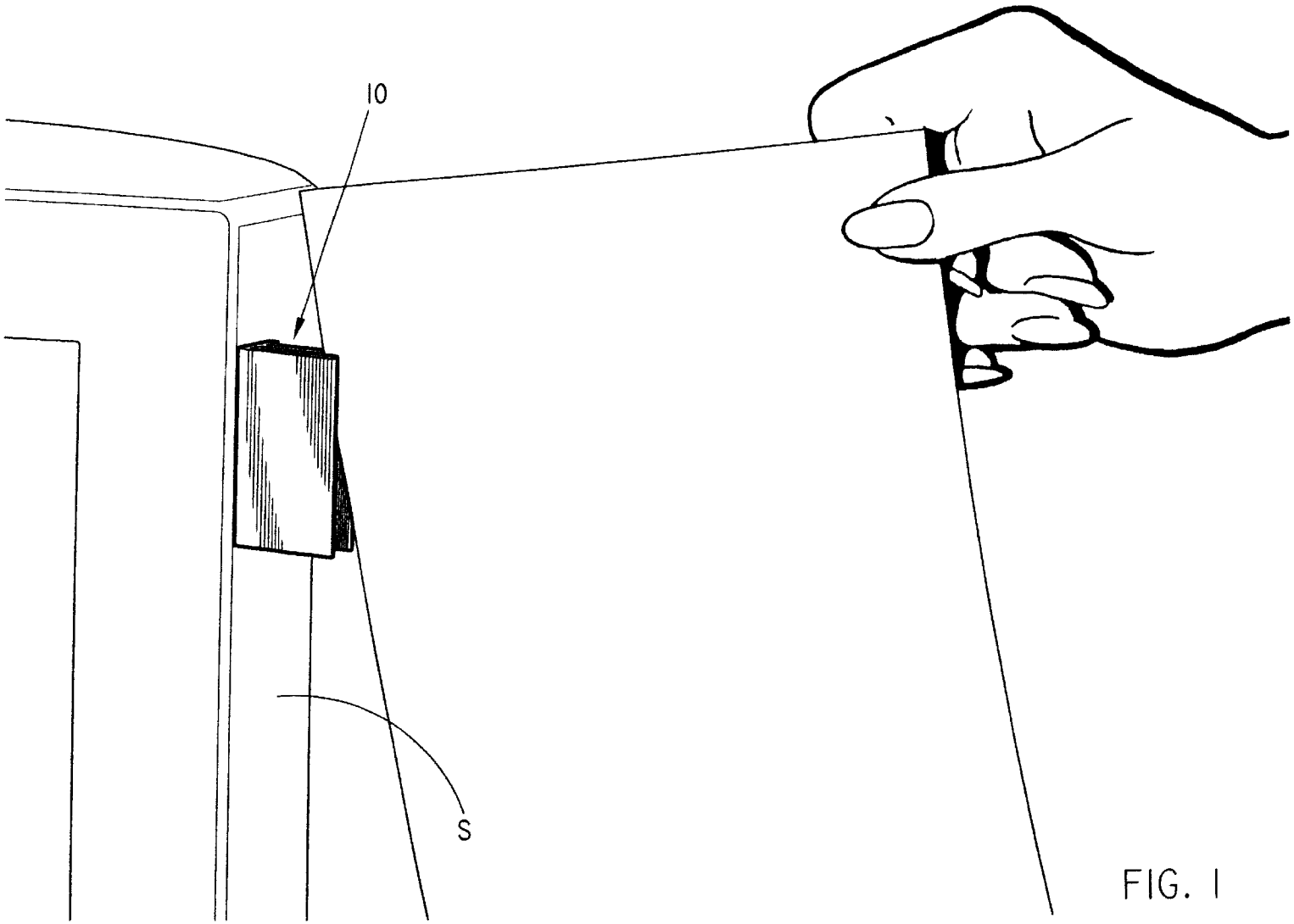
FIG. 1 is a perspective view of a document holder of the present invention mounted to a surface.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A document holder 10 of the present invention is provided to frictionally hold a sheet of paper in any orientation. The document holder 10 is substantially smaller than a regular 8½"×11" sheet of paper. Preferably, the document holder is about 1.5" wide and about 2" tall. It includes a base 12 from which a front wall 14 and a back wall 16 extend. The front and back walls include inner and outer surfaces. The outer surfaces of the front and back walls are preferably generally parallel with each other. However, the inner and outer surfaces of the respective walls are not parallel, and the front and back walls both vary slightly in thickness from the top of the walls to the bottom of the walls; the walls being slightly thicker at their bottoms than at their tops. As seen, the base 12 is preferably not perpendicular to the front and back walls 14 and 16. Rather, the base defines an angle of about 95° to about 100° with the outer surfaces of the front and back walls. The bottom of the base 12 includes a pocket 18, which receives, for example, an adhesive strip having a removable coating. The coating protects the adhesive strip prior to mounting of the document holder 10 to a surface S. The adhesive strip coating is removed to enable the document holder to be secured to a surface. Although shown to use an adhesive strip to mount the document holder to a surface, the document holder can be mounted to a surface in other ways as well. For example, and without limitation, the document holder can be mounted to a surface using a magnet, glue, suction cups, etc. The surface S to which the document holder is to be secured can be a vertical surface (such as the side of a computer monitor or a cabinet wall) or horizontal surface (such as the underside of a cabinet or a countertop). Thus, the document holder 10 can be used in a vertical orientation to hold paper from the side or in a horizontal orientation to hold paper from the top or bottom of the paper.

The front and back walls 14 and 16 are spaced apart from each other to define a slot 19 into which paper can be inserted. Importantly, the slot is open at its top and along its sides. Preferably, the back wall 16 is taller than the front wall 14. The taller back wall facilitates the insertion of paper into the slot 19, as seen in FIG. 1. A user can simply place the paper anywhere on the outer surface of the front wall, wipe it toward the protruding back wall until it snaps on to the back wall at which point it can be easily inserted into the slot 19. This will enable persons to quickly and easily insert papers into the document holder without having to look back and find the slot. This eliminates the need for the user to align the paper with the slot in order to insert the paper into the slot.

The front wall 14 is generally planar, extending the full width of the document holder 10. As seen, the outer surface of the front wall is also preferably flush with an edge of the base 12. Hence, the base 12 does not extend beyond the front wall 14. However, if desired, the front and back walls could be positioned to be generally centered on the base 12, or to be toward the opposing edge of the base 12. The front wall 14 includes at least two spaced apart projections 20 extending from the inner surface of the front wall 14 toward the back wall 16. The back wall 16 also is generally planar and includes at least two side projections or walls 22 and a central projection 24. The projection 24 has a length at least equal to the distance between the free ends of the projections 20 and the inner surface of the back wall 16. Hence, at a minimum, the free ends of the projections 20 and 24 are co-linear. The projections 20 and 24 can each have a length such that the projections overlap each other. The projections each have friction-inducing edges that engage the paper, and the natural resilience of the paper against these edges retains one or more sheets of paper in a selected location along the sheet(s). That is, the sheet(s) is (are) retained in the document holder whether the sheet(s) is inserted into the document holder near the top, middle, or bottom of the sheet.

Figure 2:
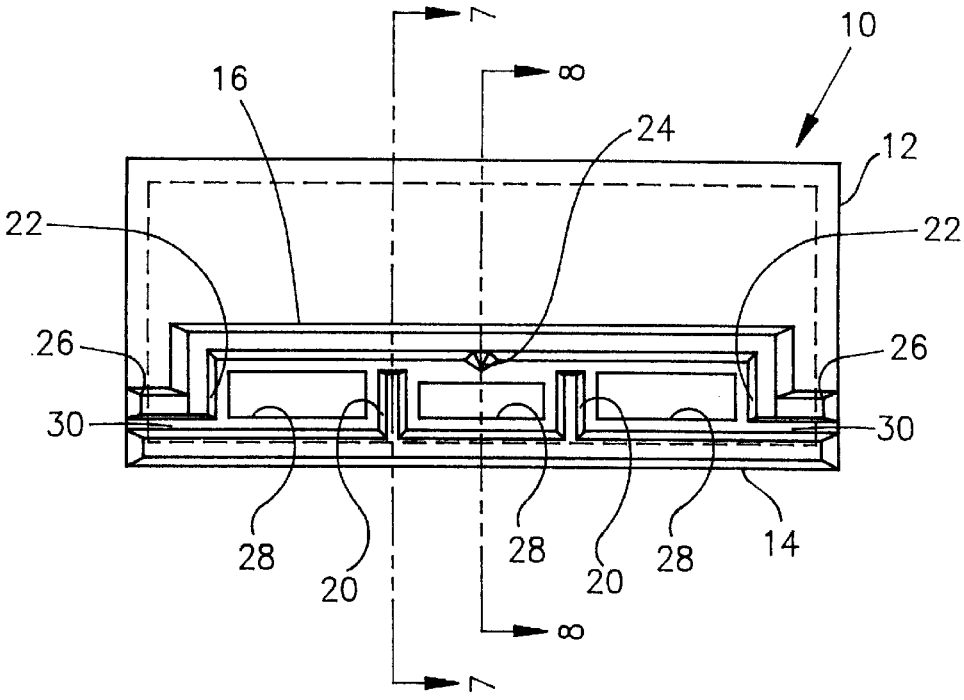
FIG. 2 is a top plan view of the document holder.
Figure 3:
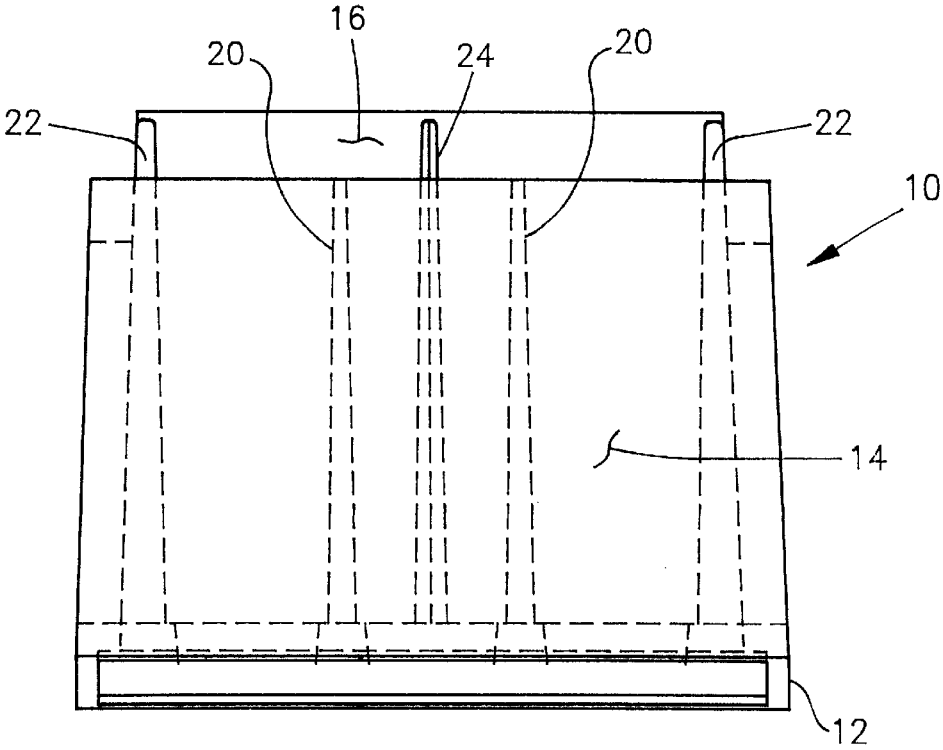
FIG. 3 is a front elevational view of the document holder.
Figure 4:
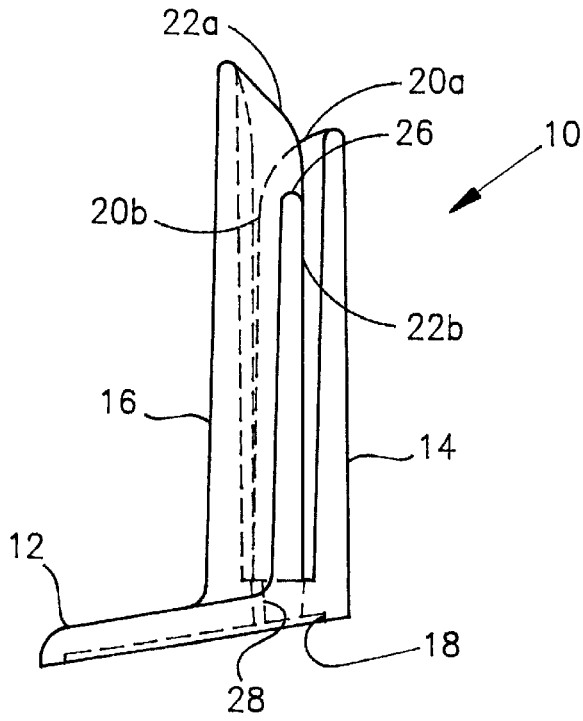
FIG. 4 is a right side elevational view of the document holder.
Figure 5:
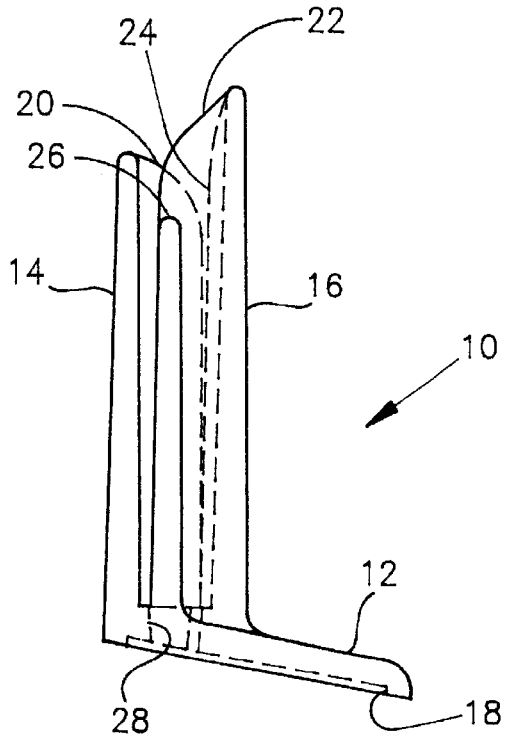
FIG. 5 is a left side elevational view of the document holder.
Figure 6:
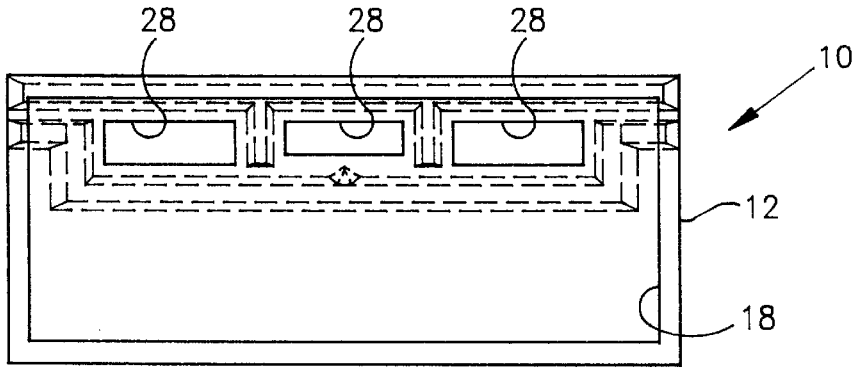
FIG. 6 is a bottom plan view of the document holder.
Figure 7:
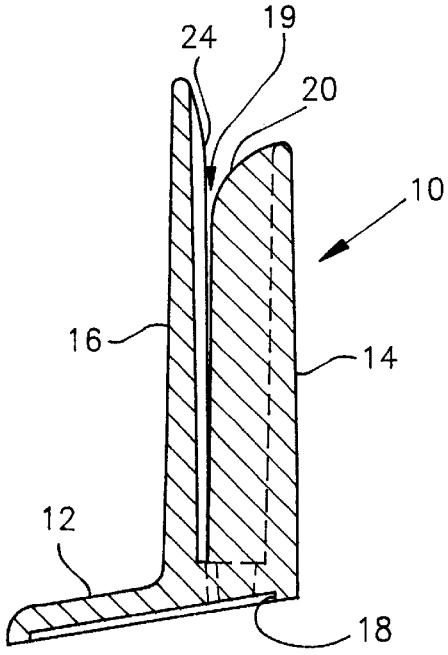
FIGS. 7 and 8 are vertical cross-sectional views of the document holder taken along lines 7—7 and 8—8 of FIG. 2, respectively.
Figure 8:
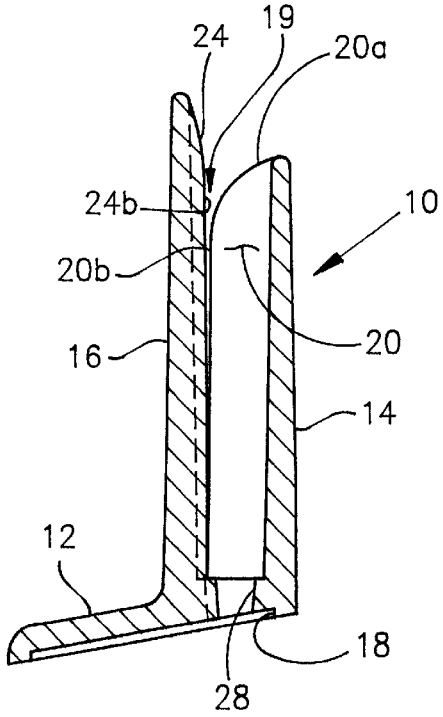

As can be seen best in FIG. 2, the side projections 22 form side walls to the holder and there is a gap between the end of the side walls 22 and the inner surface of the front wall 14 through which paper can extend. The walls 22 and projections 24 extend from the inner surface of the back wall 16 towards the front wall 14. The projections 20 and 24 and the walls 22 are positioned on the front and back walls such that the projections 20 are positioned between the walls 22 and the projection 24. The front wall projections 20 have upper surfaces 20*a* which are arced and back surfaces 20*b* which are sloped, such that the distance between the projection surface 20*b* and the back wall inner surface is smaller at the bottom of the projection than at the top of the projection. Similarly, the sidewalls 22 of the back wall 16 each have a sloped upper surface 22*a* and a sloped front surface 22*b*. The slope of the front surface 22*b* is significantly steeper than the slope of the top surface 22*a*. The sidewall front surface 22*b* is sloped such that the distance between the wall surface 22*b* and the front wall inner surface is smaller at the bottom of the sidewall than at the top of the sidewall. Hence, as can be appreciated, the projections 20 and walls 22 are wider at their bases than at the their tops. Additionally, the projections 20 and walls 22 have a width over a majority of the height of the projections which is greater than one-half the width of the slot between the inner surfaces of the front and back walls, such that the projections 20 and walls 22 overlap each other. The back wall central projection 24 is substantially smaller in width than the front projections 20 and the side walls 22 and protrudes only slightly into the slot 19. The forward edge of the projection 24 is generally parallel to the back wall outer surface. The projection is shown to be generally triangular in plan, but could be any other shaper, for example, the projection could be rectangular, triangular, trapezoidal etc. As best seen in FIGS. 2 and 3, the projection 24 is centered with respect to both the sidewalls 22 and the projections 20. However, the projections 20 are closer to the projection 24 than the side walls are to the projections 20. Stated differently, the distance between the sidewalls 22 and the projections 20 is greater than the distance between the projections 20 and the projection 24. As noted above, the projections 20 and sidewalls 22 both have sloped surfaces. The distance between these sloped surfaces of the projections 20 and the sidewalls 22 and their opposing surfaces varies, as best seen in FIGS. 7 and 8.

The base 12 includes openings 28 between the projections. These openings are provided primarily to enhance the molding process. The inclusion of the holes in the document holder helps reduce mold maintenance and, consequently, increases mold life. The mold includes fingers, which define the slot between the front and back walls of the holder. These mold fingers are received in openings in the mold base so that the mold fingers will be locked into place with respect to the mold base during injection of the plastic resin into the mold. If the mold fingers were not fixed in place and engaged with the mold base, the pressure of the resin during injection of the resin can cause the mold portion which forms the slot between the front and back walls to deflect.

Preferably, the holder includes an extension 26 projecting outwardly from the forward ends of the sidewalls 22. The extensions 26 each have an inner surface which faces, and is generally parallel to, the inner surface of the front wall 14. The back wall 16 has a side-to-side width, which is less than the side-to-side width of the front wall 14. The combined side-to-side width of the back wall 16 and the sidewall extensions 26 is approximately equal to the side-to-side width of the front wall 14. The extensions 26 and the front wall 14, in combination, define channels 30 on opposite sides of the slot 19 and which open into the slot 19. As best seen in FIG. 2, the two channels 30 are co-linear with each other or in the same plane with one another. Further, as can be seen, the channels 30 are spaced forewardly from the free ends of the projections 20.

As can be appreciated, the projections 20 and 24 and the sidewalls 22 will impart a slight bend, curvature, or deflection in paper when paper is inserted into the holder. This curve provides rigidity to the paper so that the paper will stand erect when held from its sides or bottom. When the paper is held from the top or bottom, the side channels 30 help ensure that the opposite sides of the paper will be essentially in the same plane. Thus, the paper extending from the document holder 10 will be essentially flat.

The edges of the projections are friction-inducing edges. The projections 20 and 24 are sized and positioned such that when paper is placed in the slot 19, the projection 24 will urge the paper against the projections 20, and the projections 20 will urge the paper against the projection 24 such that the projections 20 and 24 frictionally grip the paper. Additionally, the channels 30 are spaced forewardly from the free ends of the projections 20. Hence, the paper will have to curve from their point of engagement with the projections 20 to pass through the channels 30. This induced curvature causes the paper to engage the sidewalls at their inner corners, such that the corners frictionally engage the paper. As can be appreciated, due to the overlap of the projections, the paper inserted in the slot 19 will bend or curve around the projections 20, 22, and 24. The frictional grip of the projections on the paper is sufficient to hold the paper in the document holder, whether the paper is held from the top, bottom, or side. Hence, the paper will not slide through the document holder or rotate out of the document holder. If the paper is held from the side, the paper can easily be moved up and down relative to the document holder to help, for example, a typist to maintain his or her place on the paper. Further, the slight curvature introduced into the paper by the projections will help to prevent the paper from bending should the paper be held by the side and near the bottom of the paper.

The varying width of the slot 19 (from the top end of the slot to the base of the document holder) enables the document holder to frictionally grip and hold different numbers of sheets of paper equally well. Hence, if the document holder is designed to accept, for example, 6 sheets of paper, it will grip one sheet of paper as well as it will grip 6 sheets of paper. As can be appreciated, due to the varying width of the slot, one sheet will slide down into the slot further than six sheets. The distance between the front and back walls, and, the distances between the friction edges of the projections and the inner surface of the opposing wall can be varied for specific use applications, i.e., to accommodate different number of sheets of paper, or different paper stock.

Preferably, the document holder 10 is produced from plastic by injection molding. However, the document holder can be produced in any other desired manner. If injection molded, the projections and walls are all preferably of the same approximate thickness.

As various changes could be made in the above constructions without departing from the scope of the invention, it is intended that all matter contained in the above description or shown in the accompanying drawings shall be interpreted as illustrative and not in a limiting sense. For example, more or fewer projections could be used, as desired. The extensions 26 could be eliminated if desired. The width of the slot can be varied to hold different number of sheets of paper or different paper stock (i.e., copy or printer paper vs. note cards). The document holder can be adapted to be mounted to surfaces using, for example, magnetic strips, rather than adhesive. This will allow the document holder to be mounted, for example, on a refrigerator or other ferrous surface. Hook and loop fasteners (such as Velcro) can also be used to removably mount the document holder to a surface. In this case, however, one of the strips of the Velcro would have to be adhered to the surface, for example, with an adhesive strip. The back wall side projections could be made to be wide projections. In this case, the extensions 26 would, in effect, be incorporated into the projections 22. The projections could be reversed, such that the projections 20 are on the back wall and the projections 22 and 24 are on the front wall. The central back wall projection 24 can be wider if desired, and can have any desired shape. That is, it does not have to be triangular. These examples are merely illustrative.

What is claimed is:

1. A document holder adapted to be mounted to a surface comprising:

a. a base; a first wall and a second wall, said first and second walls being spaced apart from each other to define a slot there between, said first and second walls each having inner and outer surfaces;

b. at least two first wall projections extending from the inner surface of the first wall and at least one second wall projection extending from the inner surface of the second wall; said at least two first wall projections being on opposite sides of said at least one second wall projection; said first and second wall projections extending generally perpendicularly to said base;

c. said first wall projections having a length at least equal to the distance between said second wall projection and the inner surface of said first wall, such that when paper is inserted into said slot between said first and second walls, said first and second wall projections will frictionally engage said paper with sufficient frictional force to hold said paper no matter the orientation of said holder; and d. channels extending from opposite sides of said slot, said channels being open along a top and an outer side of said channel; said channel having a width less than the width of said slot.

2. The document holder of claim 1 wherein the second wall is a back wall and said first wall is a front wall; said second wall extending above the first wall.

3. The document holder of claim 1 wherein the base is sloped relative to the first and second walls.

4. A document holder adapted to be mounted to a surface comprising:

a. a base; a first wall and a second wall, said first and second walls being spaced apart from each other to define a slot there between, said first and second walls each having inner and outer surfaces;

b. at least two first wall projections extending from the inner surface of the first wall and at least one second wall projection extending from the inner surface of the second wall; said at least two first wall projections being on opposite sides of said at least one second wall projection;

c. said first wall projections having a length at least equal to the distance between said second wall projection and the inner surface of said first wall, such that when paper is inserted into said slot between said first and second walls, said first and second wall projections will frictionally engage said paper with sufficient frictional force to hold said paper no matter the orientation of said holder;

d. at least said first wall projections have a width greater than one-half the distance between the first and second walls; at least said first wall projections including a sloped edge such that the length of said first wall projections is greater at the bottom of the first wall projections than at the top of the first wall projections.

5. A document holder adapted to be mounted to a surface comprising:

a. a base; a first wall and a second wall, said first and second walls being spaced apart from each other to define a slot there between, said first and second walls each having inner and outer surfaces;

b. at least two first wall projections extending from the inner surface of the first wall and at least one second wall projection extending from the inner surface of the second wall; said at least two first wall projections being on opposite sides of said at least one second wall projection;

c. said first wall projections having a length at least equal to the distance between said second wall projection and the inner surface of said first wall, such that when paper is inserted into said slot between said first and second walls, said first and second wall projections will frictionally engage said paper with sufficient frictional force to hold said paper no matter the orientation of said holder;

d. at least two side walls extending from said second wall toward said first wall, there being a gap between a free end of said side walls and the inner surface of said first wall, said gap opening into said slot between said first and second walls; said side walls having a length greater than the distance between a free end of said first wall projections and the inner surface of said second wall.

6. The document holder of claim 5 wherein said side walls each have a length greater than ½ the width of said slot.

7. The document holder of claim 5 including an extension projecting outwardly from the forward edge of each side wall, said extensions each defining a channel between said extension and said first wall which is aligned with said gap between said side wall and said first wall; said channels opening into said slot via said gap.

8. A document holder adapted to be mounted to a surface comprising:

a. a base; a front wall and a back wall, said front and back walls each having inner and outer surfaces and being spaced apart to define a slot between said front and back walls;

b. at least one inner projection extending from the inner surface of one of said front and back walls; and two side walls extending from the inner surface of the other of said front and back walls; there being a gap between a free end of said side walls and the surface opposing said side walls;

c. said inner projection and said side walls each having a width greater than one-half the distance between the front and back walls; said inner projection and side walls further including sloped edges such that the length of said inner projection and side walls is greater adjacent the base of the document holder than at the top of the document holder.

9. The document holder of claim 8 including channels at opposite edges of said document holder; said channels opening into said slot.

10. The document holder of claim 8 including extensions projecting from said side walls, said extensions being generally parallel to the wall opposing said side walls; said extensions and said opposing wall defining said channels.

11. The document holder of claim 8 wherein said inner projection and side walls each have top edges, said top edges being sloped or curved.

12. A document holder adapted to be mounted to a surface comprising:

a. a base; a front wall and a back wall, said front and back walls each having inner and outer surfaces and being spaced apart to define a slot between said front and back walls;

b. at least one inner projection extending from the inner surface of one of said front and back walls; and at least two outer projections extending from the inner surface of the other of said front and back walls, said projections alternating with respect to each other; and c. channels at opposite edges of said document holder, said channels opening into said slot; said channels being spaced rearwardly from a free end of said outer projections; such that, when a paper is inserted in said slot, a curvature will be induced in said paper.

13. A document holder adapted to be mounted to a surface comprising:

a. a base; a front wall and a back wall, said front and back walls each having inner and outer surfaces and being spaced apart to define a slot between said front and back walls;

b. at least one inner projection extending from the inner surface of one of said front and back walls; and at least two outer projections extending from the inner surface of the other of said front and back walls, said projections alternating with respect to each other; and c. side walls extending from the wall opposite the wall from which said outer projections extend; said extensions projecting outwardly from said side walls, said extensions, in conjunction with the wall opposing said side walls, defining channels at opposite edges of said document holder; said channels opening into said slot.

14. The document holder of claim 13 wherein said channels are co-linear with each other.

* * * * *